United States Patent [19]

Lee

[11] Patent Number: 5,019,744

[45] Date of Patent: May 28, 1991

[54] DIRECT HEATING TYPE CATHODE STRUCTURE

[75] Inventor: Seung-jae Lee, Suwon, Rep. of Korea

[73] Assignee: Samsung Electron Devices Co., Ltd., Rep. of Korea

[21] Appl. No.: 433,150

[22] Filed: Nov. 9, 1989

[30] Foreign Application Priority Data

Nov. 17, 1988 [KR] Rep. of Korea ..... 88-15126

[51] Int. Cl.[5] ..... H01J 1/16; H01J 1/15

[52] U.S. Cl. ..... 313/346 R; 313/451; 313/456; 313/482

[58] Field of Search ..... 313/346 R, 451, 456, 313/482, 446

[56] References Cited

FOREIGN PATENT DOCUMENTS 51-82561 7/1976 Japan ..... 313/346 R 0184431 10/1984 Japan ..... 313/346 R

*Primary Examiner*—Donald J. Yusko
*Assistant Examiner*—N. D. Patel
*Attorney, Agent, or Firm*—Leydig, Voit & Mayer

[57] ABSTRACT

A direct heating cathode includes an emitter for emitting electrons and a generally W shaped heater connected at opposite ends to terminals having a flat portion on which the emitter is mounted, bent portions at opposite sides of the flat portion, and an upwardly projected shoulder portion in the vicinity of each of the ends of the heater. Each of the bent portions of the heater includes two oppositely directed bends between the flat portion and the proximate heater end. The cathode structure elevates the temperature of the cathode at the position of the emitter, reducing power consumption and improving start-up speed, operational stability, and life expectancy.

4 Claims, 2 Drawing Sheets

DIRECT HEATING TYPE CATHODE STRUCTURE

FIELD OF THE INVENTION

The present invention relates to a direct heating cathode structure and, particularly, to a direct heating cathode structure for use in a small cathode ray tube.

BACKGROUND OF THE INVENTION

A small cathode ray tube is used in an electronic view finder (EVF) of a portable VTR (so-called cam corder) or in a portable TV reciever, A cathode ray tube for these purposes requires super compactness, low power consumption, quick start-up, and the like, because such a portable VTR or TV uses batteries as the power source.

The cathode which emits electrodes in a small cathode ray tube is usually a direct heating type. A direct heating cathode structure includes an electrode emitter installed at the middle of a heater made of a metal wire or a metal piece. The cathode is operated so that the emitted electrons are focused in a beam by an electrostatic lens including one or more of grids or electrodes. The electron beams thus focused are scanned onto a phosphorescent screen to proper images.

However, the heater can be heated by the self-generated heat to produce a thermal deformation, with the result that the distance between the electron emitter and the grids or electrodes forming electrostatic lens are varied. If the emitter is displaced toward the electrodes, then the time required for operationally stabilizing the cathode is increased, and the cut-off characteristics are lowered, with the result that the electron emissions can not be stabilized.

Accordingly, various techniques have been proposed in order to prevent drifting of the emitter due to the thermal deformation of the heater. An example is described in Japanese Utility Model Publication No. Sho 60-3481.

According to this method, both ends of a heater on which an emitter is disposed are connected to an elastic body in order to tension the heater to inhibit thermal deformation during the operation of the heater. However, such a method has various problems as described below. For example, the heater receives a tensile stress, and therefore its dimensions are increased, with the result that power consumption is increased, and the heater is easily degraded due to fatigue, thereby shortening the life expectancy of the cathode. Further, the heater structure is very complicated, raising the manufacturing cost, and the heat loss is also enormous.

Another attempt for overcoming the disadvantages of the previous techniques is disclosed in Japanese Published Patent Application 59-184431. According to this method, a metal piece is formed in an approximate W shape as shown in FIG. 1. This metal piece is secured to a terminal 6 which is supported by a supporter 7, thereby forming a heater 2', with an electronic emitter 1 placed at the middle of the heater 2'.

This W shaped cathode structure above compensates structurally for thermal expansion as shown in FIG. 2 by moving to the position shown by the broken lines from the cold position shown by the solid lines when the heater 2' produces heat, so that the drifting of the emitter 1 from position 3 to position 3' is inhibited.

However, in this method, the expansion amounts are compensated simply based on the difference of the expansion directions of the different parts, and therefore, the drift inhibiting effect for the emitter is not sufficient. Further, a severe springing-back phenomenon occurs when the metal piece is bent into a W shape of heater, with the result that the rate of defective products is very high, reducing yield. Further, the bent portion indicated by reference numeral 4' in the drawing is a sharp point where heat is concentrated and, therefore, a considerable amount of heat is dissipated without being used in heating the emitter, with the result that the power loss is very large, and the period of time from first supplying power until electron emission is very lengthy, so that a quick start-up, is not expected. Further, the above mentioned bent portion 4' is a region where not only heat is concentrated, but also thermal stress and fatigue occurs most intensely due to the repetitions of the expansions and contractions caused by the heat concentration. Therefore this portion 4' is quickly damaged, shortening the life of the cathode.

SUMMARY OF THE INVENTION

The present invention is intended to overcome the above described disadvantages of the conventional techniques.

Therefore, it is an object of the present invention to provide a direct heating cathode structure in which the drifting of the emitter due to thermal deformation of the heater is compensated and the cut-off characteristics are improved, thereby so that a rapid stabilization of a cathode ray tube is expected.

It is another object of the present invention to provide a direct heating cathode structure in which the heat generated from the heater is focused toward the emitter, thereby improving thermal efficiency and lowering power consumption so that a quick start-up is expected.

It is still another object of the present invention to provide a direct heating cathode structure in which there are no thermal stress and fatigue stress concentrations, thereby achieving a long life.

In achieving the above objects, according to one feature, the direct heating cathode structure of the present invention includes an emitter for emitting electrons, a heater formed approximately in a W shape and including a central flat portion on which the emitter is mounted, a shoulder projecting in the upward direction in the orientation shown in FIG. 3 at each of the opposed ends of the heater, and a pair of terminals to which the opposed ends of the heater are respectively connected.

According to another feature of the direct heating cathode structure of the present invention, the cathode includes an emitter for emitting electrons, a heater formed approximately in a W shape, including a central flat portion on which the emitter is mounted, bent portions at the opposite sides of the flat portion, each including two mutually opposite-direction bends, and a pair of terminals to which the ends of the heater are respectively connected.

In a cathode according to the invention, the heat generated from the shoulder portions of the heater is radiated toward the flat portion where the emitter is installed, focusing the heat of the heater on the emitter, thereby increasing thermal efficiency, reducing the power consumption of the cathode ray tube, and making it possible to achieve a quick start-up.

According to another feather of the device of the present invention, compensation for drifting of the emitter achieved not only by the oppositely expanding directions of the parts of the heater, but also by displacing the emitter geometrically opposite the outward direction, with the result that the drift inhibiting effect is very large.

BRIEF DESCRIPTION OF THE DRAWINGS

The above objects and other advantages of the present invention will become more apparent by describing in derail the preferred embodiment of the present invention with reference to the attached drawings in which.

DESCRIPTION OF THE PREFERRED EMBODIMENT

Figure 1:
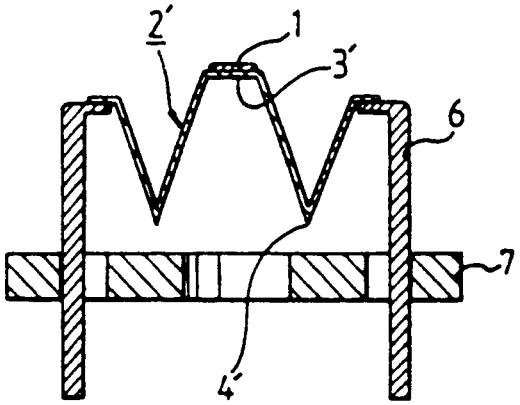
FIG.1(Prior Art)
FIG. 1 is a schematic sectional view of an example of the conventional direct heating cathode structures.
Figure 2:
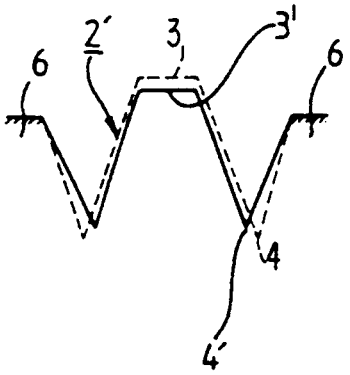
FIG 2(Prior Art)
FIG. 2 illustrates the displacements upon heating of the direct heating cathode structure of FIG. 1.
Figure 3:
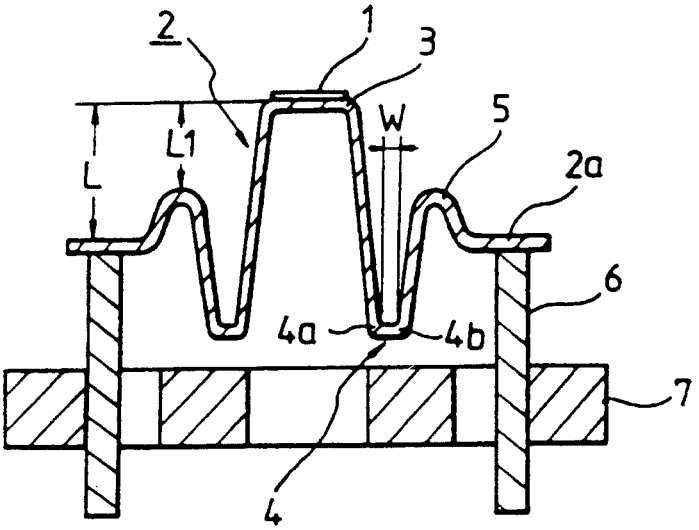
FIG. 3 is a schematic sectional view of the embodiment of a direct heating cathode structure according to the present invention.

The direct heating type cathode structure according to the present invention as shown in FIG. 3 includes an emitter 1 for emitting electrons mounted on an approximately W shaped heater 2, the opposite ends 2*a* of which are connected to terminals 6 which are in turn supported on a supporter 7 made of an insulating material.

The heater 2 is made of a nickel alloy and the like and is formed of a metal piece or metal wire. The heater 2 is symmetrically formed relative to its center axis. A flat portion 3 for mounting the emitter 1 is formed at the middle of the heater 2, and the heater extends from the middle flat portion downwardly, i.e., toward support 7, in the opposite directions relative to the center axis. Shoulder portions 5 project upwardly, i.e., away from support 7, in the vicinities of the respective end portions 2*a* which are connected to the terminals 6. Between the downward extension in the opposite directions from the middle flat portion 3, the heater extends generally parallel to support 7 at bent portions 4 and then upwardly to shoulder portions 5.

Meanwhile, each of the bent portions 4 includes first and second beads 4*a*, 4*b* which are distinguishable based on the opposite bending directions.

In the direct heating cathode structure according to the present invention, if the power source is applied through a circuit (not shown) to the opposite ends of the heater 2, then the heater 2 starts generating heat and, accordingly, the emitter 1 installed on the heater 2 emits electrons after being heated by the heater 2.

Under this condition, the shoulder portions 5 radiate heat toward the emitter 1 and focus the heat on the emitter 1. The cathode temperature (°C.) at the position of the emitter 1 as a function of the sizes of the shoulder portions 5 are shown in Table 1 below, assuming a power consumption type of 100 mW.

TABLE 1

| L1/L | 1/6 | 2/6 | 3/6 | 4/6 | 5/6 | 6/6 |
|---|---|---|---|---|---|---|
| Cathode temperature (°C.) | 725 | 725 | 715 | 710 | 700 | 680 |

In the table, L represents the height between the flat portion 3 and the end portions 2*a*, and L1 is the height between the flat portion 3 and the peak level of the shoulder portions 5 as illustrated in FIG. 3.

In the conventional cathode structure in which the shoulder portions 5 are not provided (L1/L=6/6), the temperature of the cathode at the position of the emitter is about 680° C., whereas, in the cathode structure of the present invention in which the shoulder portions 5 are provided, the temperature of the cathode is elevated, the temperature elevations for L1/L less than or equal to 2/6 being approximately the same. Consequently, the period of time required for starting the emission of electrons, i.e., the image-forming time is shortened, thereby making it possible to expect a quick start-up the cathode ray tube and increasing thermal efficiency to save power.

Figure 4:
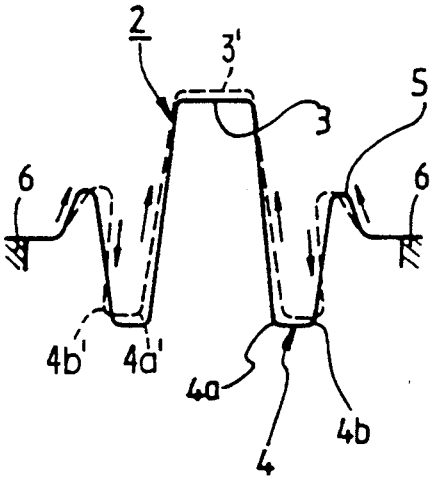
FIG. 4 illustrates the displacements upon heating of the direct heating cathode structure of FIG. 3.

Meanwhile, if the heater 2 starts generating heat, the position of the emitter 1 will drift due to thermal deformation, the thermal deformation mechanism for the cathode structure according to the present invention being illustrated in FIG. 4.

In FIG. 4, the heater 2 which has been positioned as indicated by the solid lines will be deformed as indicated by the dotted lines after having undergone thermal expansion. Under this condition, the directions of the thermal expansion of the different parts of the heater 2 are different from one another as indicated by the arrows on the drawing. Therefore, the change of the positions of the emitter 3' due to the thermal expansion is almost totally compensated.

Meanwhile, the bent portions 4 including first and second bends 4*a*, 4*b* will elastically withstand the deformations, because the first and second bends 4, 4*b* resist deformation, thereby forming a rigid structure. Both end portions 2*a* of the heater 2 are supported by the relatively flexible shoulder portions 5 and, therefore, the heater 2 ultimately moves in the outward direction i.e., away from the support 7. Accordingly, the flat portion 3 of the heater 2, i.e., the emitter is displaced geometrically upwardly in the drawing. Therefore, in the direct heating cathode structure according to the present invention, the drifting of the emitter is compensated not only primarily by the different expansion directions of the different portions of the heater, but also due to the outward movement of the heater, thereby inhibiting the drifting of the emitter to the maximum extent.

After the compensation of the drifting of the emitter, the final deformation amount is determined by the width of the bent portions 4, i.e., the distance between the first and second bends 4*a*, 4*b*. The calculated results of the deformations for a direct heating cathode under the assumption of a power consumption of 100 mW are shown in Table 2 below.

TABLE 2

| Width (W:mm) | 0.1 | 0.2 | 0.3 | 0.4 | 0.6 |
|---|---|---|---|---|---|
| Deformation (calculated) | 0.030 mm | 0.025 mm | 0.020 mm | 0.015 mm | 0.010 mm |
| ΔEKCO (measured) | 8 | 6 | 5 | 3 | 2 |

In the above table, ΔEKCO indicates the value of the variation of the cut-off voltage, representing the difference between the maximum cut-off voltage and the minimum cut-off voltage occurring within 30 minutes, and serves as an index for the stability or the reliability of a cathode.

Thus, in accordance with increasing width W of the bent portion 4, the deformation amount and ΔEKCO are decreased. When the width W was over 0.6 mm, the deformation and ΔEKCO were almost constant.

As described above, the direct heating cathode structure according to the present invention elevates the temperature of the cathode at the position of the emitter, so that the power consumption is reduced, that a quick start-up should be assured, that operation stability can be secured by inhibiting the drifting of the emitter, and that a long life expectancy is assured by removing concentrations of thermal stress and fatigue stress. Therefore, the device of the present invention is particularly suitable for use in a small cathode ray tube of a portable VTR or in a portable TV receiver which required low power consumption and quick start-up.

What is claimed is:

1. A direct heating cathode comprising:

an electrically insulating support;

two terminals mounted in said support and separated from each other;

an emitter for emitting electrons; and a continuous generally W-shaped heater including two opposed ends, each end being connected to one of said terminals, a central flat portion on which said emitter is mounted, two generally U-shaped portions respectively connecting said central flat portion to respective ends, and two convex shoulder projecting away from said insulating support and generally toward said emitter, each shoulder being disposed between one of said respective bent U-shaped portions and said ends.

2. The direct heating cathode as claimed in claim 1 wherein the heater is symmetrical about a central axis normal to said electrically insulating support, each convex should includes a peak, and the distance from the peak of each convex shoulder to said central flat portion of said heater measured generally parallel to the axis is between 1/6 and 5/6 of the distance from one of said ends to said central flat portion measured generally parallel to the axis.

3. A direct heating cathode comprising:

two terminals;

an emitter for emitting electrons; and a continuous generally W-shaped heater including two opposed ends respectively connected to said terminals, a central flat portion on which said emitter is mounted, and two generally U-shaped portions connecting said respective ends to said central flat portion, each U-shaped portion including two generally opposed legs and a bridge joined to each of said legs, a bend being formed where each of said legs joins said bridge.

4. The direct heating cathode is claimed in claim 3 wherein the distance between said legs along said bridge exceeds 0.35 mm.

* * * * *

UNITED STATES PATENT AND TRADEMARK OFFICE

CERTIFICATE OF CORRECTION

PATENT NO. : 5,019,744

DATED : May 28, 1991

INVENTOR(S) : Seung-Jae Lee

It is certified that error appears in the above-identified patent and that said Letters Patent is hereby corrected as shown below:

Claim 1, column 6, line 1, change "shoulder" to --shoulders--.

Claim 2, column 6, line 8, change "should" to --shoulder--.

Signed and Sealed this

Eighth Day of June, 1993

Michael K. Kirk

*Attest:*

MICHAEL K. KIRK

*Attesting Officer*

*Acting Commissioner of Patents and Trademarks*